US008956135B2

(12) United States Patent
Lifson

(10) Patent No.: US 8,956,135 B2
(45) Date of Patent: Feb. 17, 2015

(54) SCREW COMPRESSOR WITH ASYMMETRIC PORTS

(75) Inventor: Alexander Lifson, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 192 days.

(21) Appl. No.: 12/935,493

(22) PCT Filed: May 26, 2009

(86) PCT No.: PCT/US2009/045178

§ 371 (c)(1),
(2), (4) Date: Sep. 29, 2010

(87) PCT Pub. No.: WO2009/148884

PCT Pub. Date: Dec. 10, 2009

(65) Prior Publication Data

US 2011/0262290 A1 Oct. 27, 2011

Related U.S. Application Data

(60) Provisional application No. 61/130,511, filed on May 30, 2008.

(51) Int. Cl.
*F04C 2/107* (2006.01)
*F01C 1/107* (2006.01)

(Continued)

(52) U.S. Cl.
CPC ..... *F04C 18/165* (2013.01); *F04C 29/0035* (2013.01); *F04C 2250/10* (2013.01)
USPC ..... 418/201.1; 418/197; 418/58

(58) Field of Classification Search
USPC ..... 418/58, 196, 201.1, 201.3, 206.1, 418/206.4, 206.5, 197; 417/310, 371, 410.4
IPC ..... F04C 2/14
See application file for complete search history.

(56) References Cited

U.S. PATENT DOCUMENTS 2,029,742 A * 2/1936 Sieverts ..... 418/72
2,481,527 A * 9/1949 Nilsson ..... 418/197

(Continued)

FOREIGN PATENT DOCUMENTS

EP 0183422 A2 6/1986
JP 62206281 A * 9/1987 ..... F04C 2/14

(Continued)

OTHER PUBLICATIONS

Koai, K. and Soedel, W., "Gas Pulsations in Screw Compressors—Part I: Determination of Port Flow and Interpretation of Periodic Volume Source" (1990). International Compressor Engineering Conference. Paper 726. http://docs.lib.purdue.edu/icec/726.*

(Continued)

*Primary Examiner* — Thomas Denion
*Assistant Examiner* — Laert Dounis
(74) *Attorney, Agent, or Firm* — Cantor Colburn LLP

(57) ABSTRACT

A multi-rotor screw compressor includes a housing, a sun rotor, and first and second planet rotors. The first planet rotor intermeshes with the sun rotor to define a first compression pair. The second planet rotor intermeshes with the sun rotor to define a second compression pair. The first and second compression pairs are rotatably mounted in the housing. The housing includes a first port, a portion of which is in communication with the first compression pair, and a second port, a portion of which is in communication with the second compression pair. The portions of the first and second ports which communicate with the first and second compression pairs have a different geometry for offsetting pulsations in a working fluid flowing through the ports.

14 Claims, 6 Drawing Sheets

(51) Int. Cl.
*F04C 18/16* (2006.01)
*F04C 29/00* (2006.01)

(56) References Cited

U.S. PATENT DOCUMENTS 3,992,133 A * 11/1976 Brunner ..... 417/366
4,815,954 A * 3/1989 Underwood ..... 418/196
4,907,954 A 3/1990 Slupski
5,028,221 A 7/1991 Malfit
6,217,304 B1 * 4/2001 Shaw ..... 418/100
6,422,846 B1 * 7/2002 Zhong et al. ..... 418/197
6,488,480 B1 * 12/2002 Zhong ..... 417/310
6,632,145 B2 10/2003 Vanmoor
2001/0010800 A1 8/2001 Kohsokabe et al.
2004/0156735 A1 * 8/2004 Lifson ..... 418/201.1
2005/0223726 A1 * 10/2005 Lifson ..... 62/196.2

FOREIGN PATENT DOCUMENTS

JP 62251485 A * 11/1987 ..... F04C 2/14
JP 2002266613 A 9/2002

OTHER PUBLICATIONS

Notification of Transmittal of the International Search Repot and the Written Opinion of the International Searching Authority, or the Declaration; PCT/US2009/045178; Mailed Jan. 4, 2010.
Extended European Search Report for EP Application No. 09759045.9-1608, mailed Nov. 13, 2013, pp. 1-11.

* cited by examiner

SCREW COMPRESSOR WITH ASYMMETRIC PORTS

CROSS-REFERENCE TO RELATED APPLICATION

This application claims priority from U.S. Provisional Application No. 61/130,511, filed on May 30, 2008 and entitled "Screw Compressor With Asymmetric Ports."

BACKGROUND

The present invention relates to helical screw compressors. More particularly, the present invention relates to a multi-rotor screw compressor having three or more rotors.

Multi-rotor screw type compressors are typically used to compress various working fluids for air conditioning and refrigeration applications. Multi-rotor compressors generally include a housing to enclose and protect the interior components of the compressor (such as the rotors). In a multi-rotor compressor, the rotors usually include a lobed sun rotor that intermeshes with, and typically drives, multiple adjacent lobed planet rotors. The intermeshed sun rotor and each adjacent planet rotor act as a compression pair; rotating about their axes relative to the housing to move the working fluid from suction inlet ports at a low pressure to discharge outlet ports at a higher pressure. The compression of the working fluid takes place in the spaces between and adjacent the flutes and lobes of the sun and planet rotors and the housing. These spaces are typically referred to as compression pockets. Each compression pocket receives working fluid as the pocket rotates with the rotors to open to a portion of the suction port. Each compression pair is also in communication with a portion of at least one discharge port. Working fluid within each compression pocket rotates with the rotors and is discharged as the rotors align with the discharge ports.

After flowing through the discharge ports, the working fluid enters a discharge channel, which interconnects with a piping system to transfer the working fluid to other components in the air conditioning or refrigeration system. It is desirable to achieve an internal pressure of the working fluid in each compression pocket equal to the pressure in the discharge channel at the moment just before each compression pocket opens to the discharge port. If the internal pressure at this moment differs from the pressure in the discharge channel, a rapid flow of working fluid through the discharge port occurs each time each compression pocket opens. This rapid flow of working fluid allows the internal pressure and the discharge channel pressure to become equalized. The flow velocity of the working fluid through the ports during this short moment of equalization is often much higher than the flow velocity of the working fluid when it is displaced out through the discharge ports by the rotors. This increase in fluid flow velocity, (and associated pressure pulsations) causes noise that may be disturbing to individuals located near the system, and may cause pressure pulsations and vibrations in various other system components that may damage the system components. The pressure pulsations may also decrease the efficiency of the compressor. It is often difficult to adapt the internal pressure to be equal to the discharge channel pressure. This is because the difference between the discharge channel pressure and the internal pressure at the end of compression process may vary as a result of many factors including: outside ambient conditions (including temperature and humidity), condenser size, and the cooling ability of the cooling medium used at the condenser.

Similarly, a change in suction flow rate may also cause suction pressure pulsations and fluid flow surges in the suction channel upstream of the suction ports. These pulsations may result in undesirable noise and vibration, and may also detrimentally affect system operating efficiency.

Typically, multi-screw compressor designs include multiple suction ports and discharge ports which correspond to and communicate with the multiple compression pairs. The geometry (the size, shape, and disposition) of each of the multiple suction ports is identical. Likewise, the geometry of each of the discharge ports is also usually identical. The identical geometry of the ports, coupled with the fact that the planet rotors are also usually of an identical size and helical geometry, and are rotated at the same angular velocity in a sun driven multi-rotor compressor, exposes or "opens" the working fluid from each compression pocket to a portion of the ports at the same time. Similarly, each compression pocket "opens" and "closes" to a portion of the suction ports at the same time. This identical porting is due to the symmetrical geometry of the suction ports with respect to the compression pairs, and the equivalent angular velocity of the planet rotors driven by the common sun rotor.

Thus, in a typical multi-rotor compressor the simultaneous opening and closing of multiple compression pockets has the undesirable effect of increasing the flow velocity of working fluid to and from the channels, as the internal pressure of several compression pockets open simultaneously to the channel and must be equalized with the pressure in the channel. Thus, when multiple compression pockets open simultaneously (in-phase with each other), the peak amplitude of the pressure pulsations in the channels increases.

SUMMARY

A multi-rotor screw compressor includes a housing, a sun rotor, and first and second planet rotors. The first planet rotor intermeshes with the sun rotor to define a first compression pair. The second planet rotor intermeshes with the sun rotor to define a second compression pair. The first and second compression pairs are rotatably mounted in the housing. The housing includes a first port, a portion of which is in communication with the first compression pair, and a second port, a portion of which is in communication with the second compression pair. The portions of the first and second ports which communicate with the first and second compression pairs have a different geometry for offsetting pulsations in a working fluid flowing through the ports.

DETAILED DESCRIPTION

Figure 1:
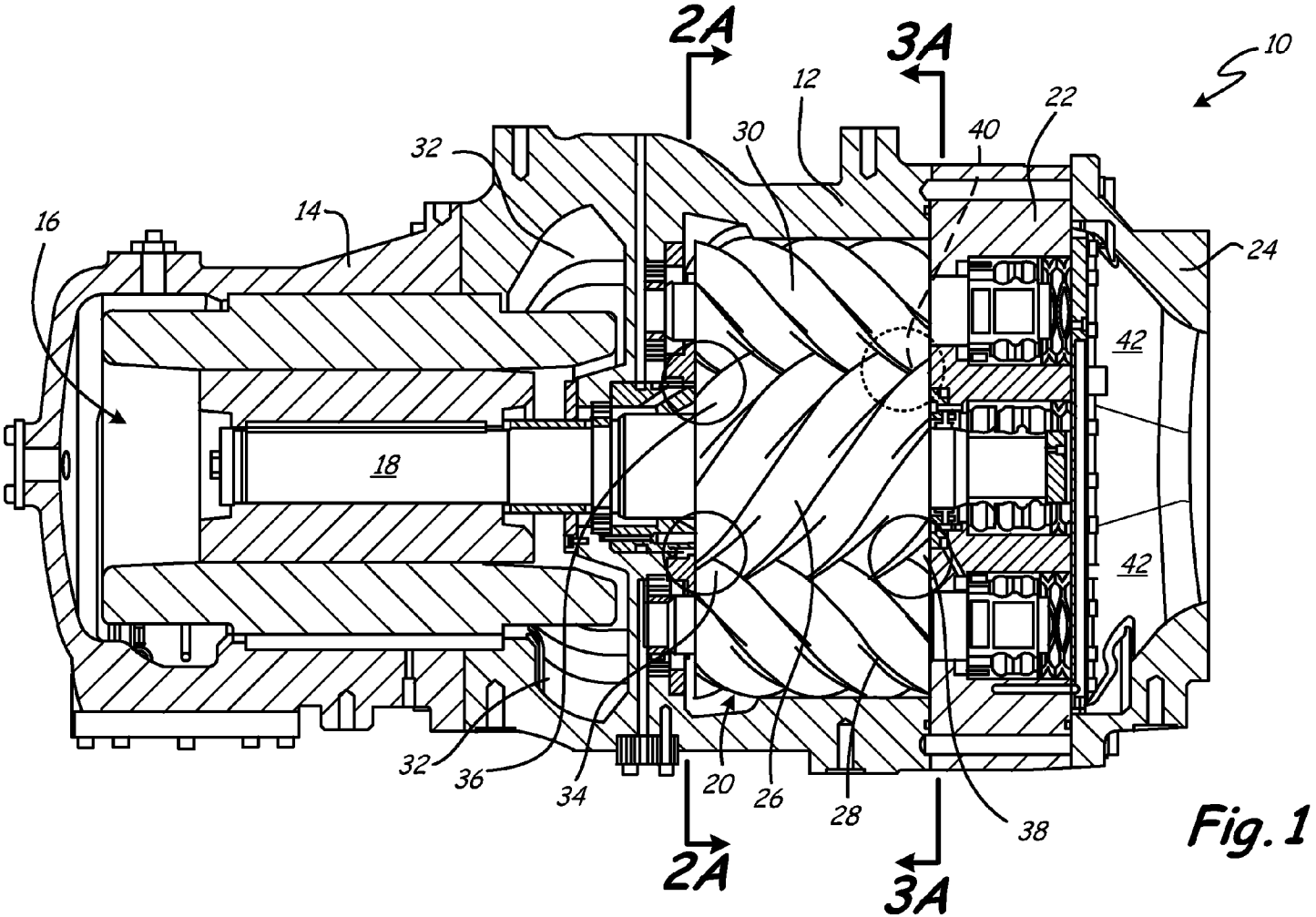
FIG. 1 is a top sectional view of a multi-rotor compressor.

FIG. 1 is a top sectional view of a compressor 10 in accordance with the present invention including a rotor housing section 12, a motor housing section 14, a motor 16, a drive shaft 18, rotors 20, a discharge housing section 22, and a discharge housing cover 24. As known in the art, instead of an electric motor driven design, the rotors 20 can be driven by other means, as for example by being coupled to an engine. The rotors 20 include a sun rotor 26, a first planet rotor 28, and a second planet rotor 30. The motor housing section 14 defines a suction channel 32. The rotor housing section 12 defines a first suction port 34 and a second suction port 36. The discharge housing section 22 defines a first discharge port 38 and a second discharge port 40. The second discharge port 40 is disposed on the opposite radial side of the rotors 20 (thus would be visible to the viewer from a bottom sectional view of the compressor 10), and therefore, is shown with a dashed line. The discharge housing cover 24 defines a discharge channel 42.

FIG. 1 illustrates an embodiment of the present invention in which the compressor 10 housing is interconnected in several sections. The sections can be separated for ease of assembly, repair or replacement of interior components of the compressor 10. In other embodiments, the compressor 10 is comprised of a single housing. The rotor housing section 12 encloses the rotors 20. The motor housing section 14 encloses the motor 16 which drives the rotors 20 via the drive shaft 18. The drive shaft 18 extends from the motor housing section 14 into the rotor housing section 12 to turn the rotors 20 about an axis defined by the drive shaft 18. The rotors 20 are rotatably disposed in the rotor housing section 12. In FIG. 1, the drive shaft 18 aligns with and turns the sun rotor 26. The sun rotor 26 has helical flutes and lobes that intermesh with corresponding helical flutes and lobes on the first planet rotor 28 and the second planet rotor 30. In this configuration, the sun rotor 26 drives the planet rotors 28, 30 to rotate the planet rotors 28, 30 in the opposite direction as the sun rotor 26. Although two planet rotors are portrayed in FIG. 1, more than two planet rotors may be driven by a single or multiple sun rotor(s) intermeshed with the multiple planet rotors.

A working fluid is drawn into the rotor housing section 12 from the motor housing section 14 through the suction channel 32. The working fluid passes from the suction channel 32 through the suction ports 34 and 36 in the rotor housing section 12 into the portion of the rotor housing section 12 containing the rotors 20. More specifically, the suction ports 34 and 36 define a communication pathway through the housing 12, (which otherwise radially and axially surrounds a good deal of the rotors 20), which allows the working fluid to pass from the suction channel 32 to the rotors 20. A portion of each of the suction ports 34 and 36 communicates with the rotors 20 adjacent an axial end portion (and in some embodiments a radial portion) of the rotors 20. The rotors 20 compress the working fluid drawn therebetween, and communicate with the first discharge port 38 and the second discharge port 40 in the discharge housing section 22 to discharge the working fluid through the discharge housing section 22 to the discharge channel 42. A portion of each of the discharge ports 38 and 40 communicates with the rotors 20 adjacent a radial portion and a second axial end portion of the rotors 20. The working fluid is discharged through the discharge ports 38 and 40 in the discharge housing section 22 to the discharge channel 42 in the discharge housing cover 24. The discharge channel 42 interconnects with piping (not shown) to transfer compressed working fluid to the other components in the air conditioning or refrigeration system.

Figure 2A:
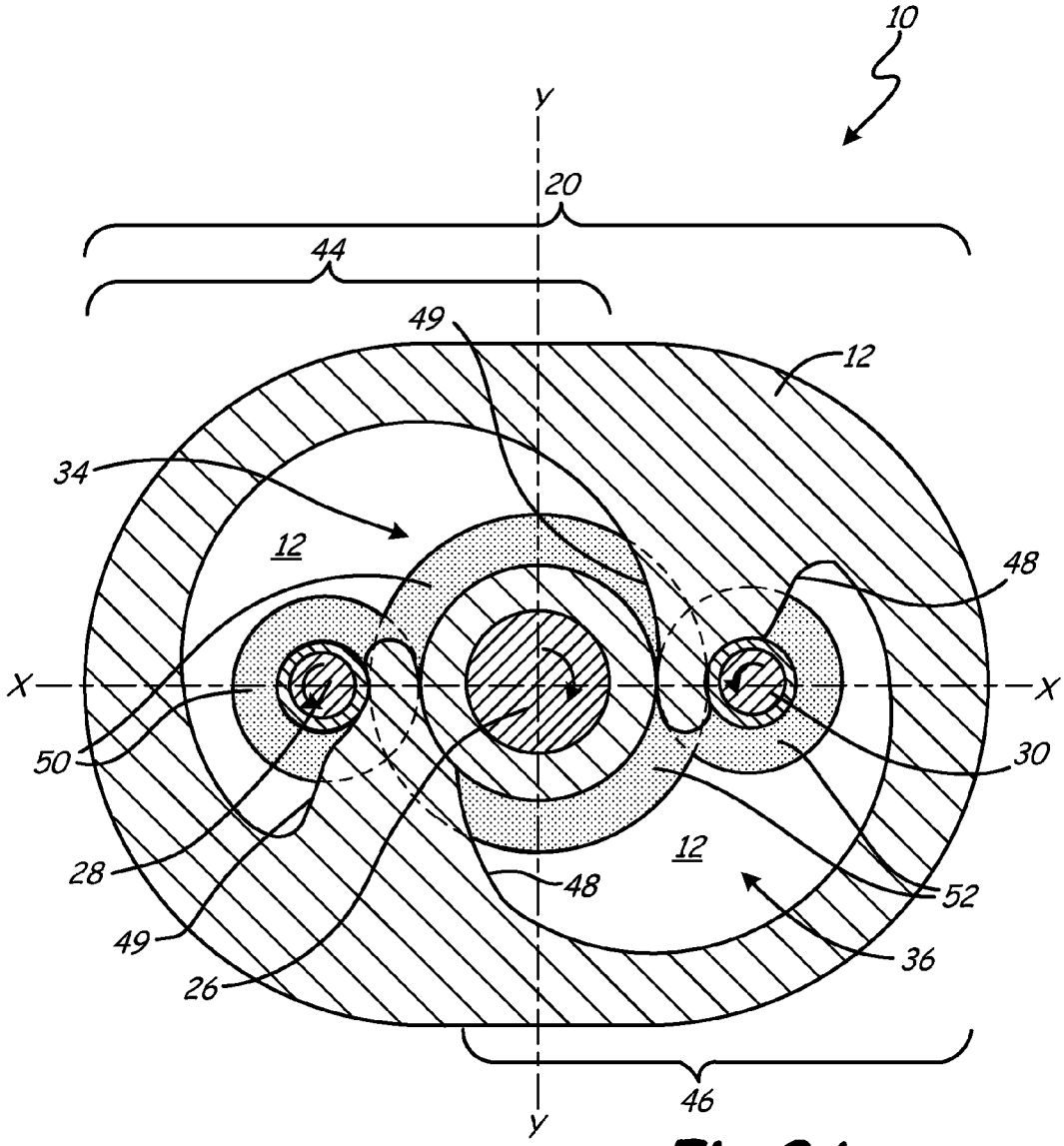
FIG. 2A is a view taken along line 2A-2A of FIG. 1 to show suction ports in accordance with an embodiment of the present invention.
Figure 2B:
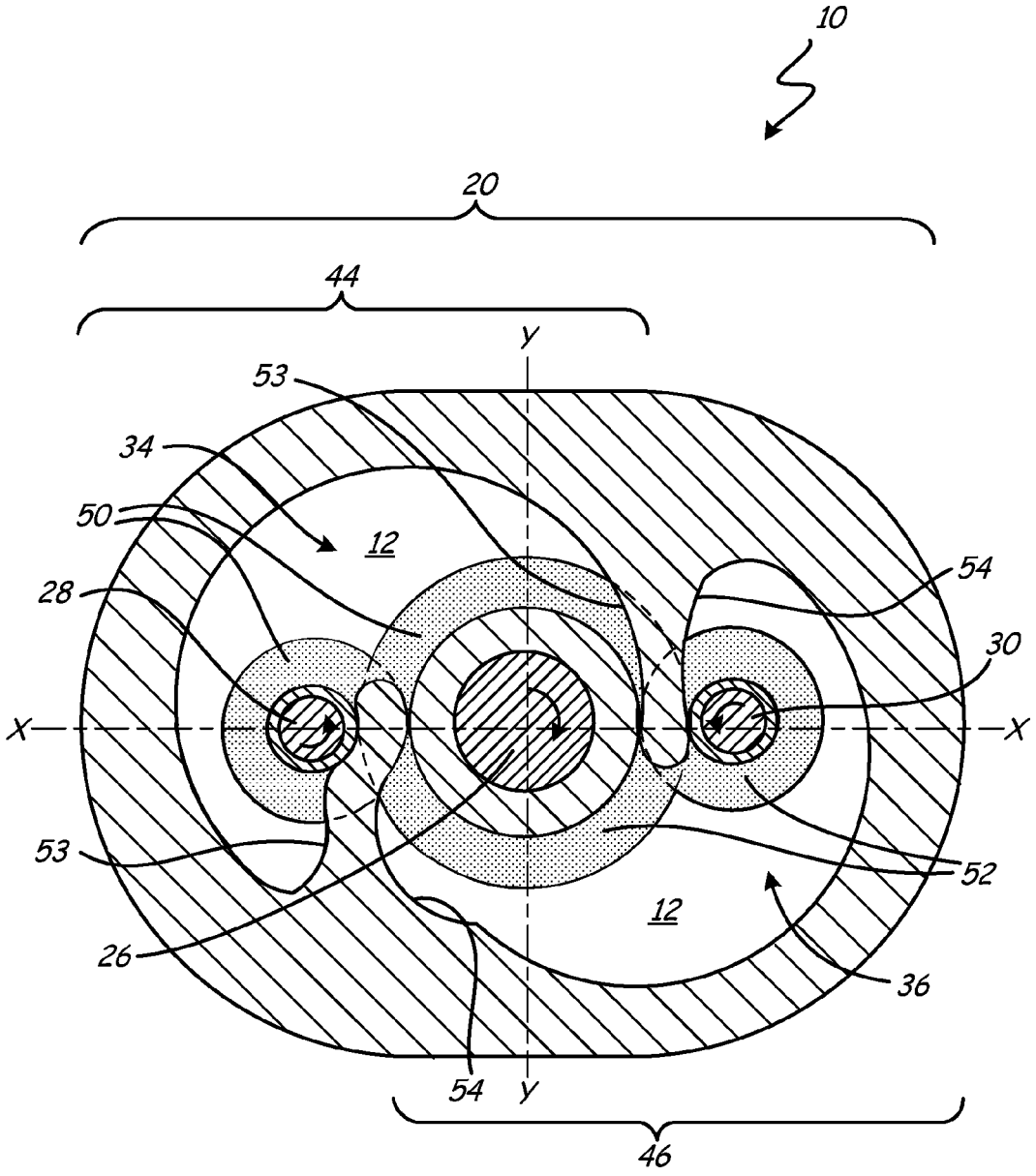
FIG. 2B is a view of the suction ports taken from the same position as FIG. 2A showing another embodiment of the present invention.

FIGS. 2A and 2B are cross sectional views of the compressor 10 viewed from the same perspective illustrating different embodiments of the interior of the rotor housing section 12 upstream (as defined by the flow path of the working fluid) and immediately adjacent to the axial end portions of the rotors 26, 28 and 30. The sun rotor 26 and first planet rotor 28 cooperate to define a first compression pair 44, with a first plurality of compression pockets 50 being defined between the flutes and lobes of a portion of the sun rotor 26 and the inner wall of the housing 12. The first compression pockets 50 are also defined by any intermeshing space between the sun rotor 26 and the first planet rotor 28, and the space between flutes and lobes of the first planet rotor 28 and the inner wall of the housing 12. In FIGS. 2A and 2B, the portion of the first suction port 34 which communicates with the first compression pair 44 corresponds to the shaded area used to indicate the first compression pockets 50 which communicate directly with the first suction port 34. Likewise, the sun rotor 26 and the second planet rotor 30 cooperate to define a second compression pair 46, with a second plurality of compression pockets 52 being defined between the flutes and lobes of the sun rotor 26 and the inner wall of the housing 12. The compression pockets 52 are also defined by any intermeshing space between the sun rotor 26 and the second planet rotor 30, and the space between the flutes and lobes of the second planet rotor and the inner wall of the housing 12. In FIGS. 2A and 2B, the portion of the second suction port 36 which communicates with the second compression pair 46 corresponds to the shaded area also used to indicate the second compression pockets 52 which communicate directly with the second suction port 36.

Still referring to FIGS. 2A and 2B, the rotor housing section 12 is configured to define the first suction port 34 and the second suction port 36 through a wall thereof adjacent the motor housing section 14. FIGS. 2A and 2B illustrate an axial section of the ports 34 and 36. Depending upon the implementation of the compressor 10, the housing 12 may be configured to define suction ports 34 and 36 of various shapes, volumetric capacity and dimensions. Accordingly, the suction ports 34 and 36 are orifices defined by the housing 12 which allow for the working fluid to travel therethrough from the suction channel 32 (FIG. 1) towards the rotors 26, 28, and 30.

A portion of the first suction port 34 is disposed in communication with an inlet end of the rotors 26 and 28. Because FIGS. 2A and 2B are cross sectional views of the compressor 10, the first and second plurality of compression pockets 50 and 52 are shown as dashed bounded area and shaded area around the first and second compression pairs 44 and 46. Because the compression pockets 50 and 52 are defined by the area between the flutes and lobes of the rotors 26, 28, and 30 and the housing 12, the compression pockets 50 and 52 rotate angularly with the rotation of the rotors 26, 28, and 30 within the housing 12. However, not all of the compression pockets 50 and 52 are in communication with the portions of the suction ports 34 and 36 (indicated as the shaded areas in FIGS. 2A and 2B) at the same moment in time. This is because the housing 12 which defines the suction ports 34 and 36 extends radially (and in some embodiments axially) with respect to the rotors 26, 28, and 30, to communicate with the axial end portions (or the radial portions if the suction ports 34 and 36 extend axially along the rotors 26, 28, and 30) of several of the compression pockets 50, 52. A portion of the first suction port 34 is in direct fluid communication with the first compression pockets 50 in the shaded area. In the shaded area, the first compression pockets 50 rotate angularly into alignment and communication with the first suction port 34. The angular rotation of the first compression pockets 50 relative to the housing 12 allows the first compression pockets 50 to be exposed to and "open" to the first suction port 34 for a limited time period. Likewise, a portion of the second suction port 36 communicates with the second compression pair 46 in the shaded area which also delineates a portion of the second plurality of compression pockets 52. In the shaded area, the second plurality of compression pockets 52 rotate angularly into alignment and communication with the second suction port 36. The angular rotation of the second plurality of compression pockets 52 relative to the housing 12 allows the second compression pockets 52 to be exposed to and "open" to the second suction port 36 for a limited time period.

Thus, the affect of the geometry of the housing 12 is to "obstruct" the pockets 50 and 52 from direct communication with portions of the suction ports 34 and 36 for a portion of their angular rotation with respect to the housing 12. As each pocket 50 and 52 rotates angularly into communication with portions of the suction ports 34 and 36, each pocket 50, 52 "opens" to the suction ports 34 and 36 in the shaded areas. Likewise, as each pocket 50 and 52 rotates angularly out of communication with portions of the suction ports 34 and 36 in the shaded areas, each pocket 50, 52 "closes" to the suction ports 34 and 36. After each pocket 50 and 52 closes to the suction ports 34 and 36, (and at some point during the rotation of the rotors 26, 28, and 30) the rotors 26, 28 and 30 and the housing 12 are configured to reduce the volume of the pockets 50 and 52, thus compressing the working fluid within the pockets 50 and 52 to a higher pressure. The working fluid flows in the compression pockets 50, 52 from the suction ports 34 and 36 to the discharge ports 38, 40 (FIG. 1).

FIG. 2A shows a cross section of the rotor housing section 12. In FIG. 2A, the portions of the suction ports 34 and 36 in communication with the axial end portions of the compression pairs 44 and 46 have an asymmetric geometry with respect to each other. This asymmetric geometry is due to the different size and shape of the portion of the first suction port 34 in communication with the compression pair 44 relative to the portion of the second suction port 36 in communication with the compression pair 46. More specifically, the housing 12 is configured such that the portion of the first suction port 34 (indicated as shaded area 50 in FIGS. 2A and 2B) in communication with the axial end portion of the first compression pair 44 is larger than the portion of the second suction port 36 (indicated as shaded area 52 in FIGS. 2A and 2B) in communication with the axial end portion of the second compression pair 46. Because of the discrepancy in the size and shape of the portions of the suction ports 34 and 36 in communication with the compression pairs 44 and 46 in FIG. 2A, the second plurality of compression pockets 52 (which angularly rotate with respect to the housing 12 as the sun rotor 26 rotates the second planet rotor 30) "close" to the second suction port 36 under trailing edges 48 before the first plurality of compression pockets 50 (which angularly rotate with respect to the housing 12 as the sun rotor 26 and first planet rotor 28) "close" to the first suction port 34 under trailing edges 49. The difference in size and/or shape between the portions of the two suction ports 34 and 36 in communication with the compression pairs 44 and 46 may be three dimensional as well as two dimensional.

In another embodiment, the asymmetry in geometry between the portions of the suction ports 34 and 36 in communication with the compression pairs 44 and 46 may be generated by shifting the disposition or alignment of the rotors 26, 28, and 30 with respect to the housing 12, while maintaining the same port 34 and 36 size and/or shape. Shifting the disposition or alignment of the rotors 26, 28, and 30 with respect to the housing 12, generates the asymmetric geometry because the location (axial and/or radial) where the suction ports 34 and 36 would come into communication with the rotors 26, 28, and 30 would differ for each suction port 34 and 36. Thus, to generate a dispositional asymmetry geometry between the suction ports 34 and 36 and rotors 26, 28, and 30, the first and second planet rotors 28, 30 and the sun rotor 26 may be aligned with respect to the housing 12 such that the first suction port 34 is disposed radially further way from an the rotational axis of the sun rotor 26 (the intersection of the X and Y axes) than the second suction port 36. This arrangement would dispose a smaller axial portion of the first planet rotor 28 in communication with the first suction port 34 (vis-à-vis the axial portion of the second planet rotor 30 in communication with the second suction port 36). If the suction ports 34 and 36 also extend axially with respect to the rotors 26, 28, and 30, the asymmetric geometry may also be generated by aligning the first and second planet rotors 28, 30 and the sun rotor 26 with respect to the housing 12 such that the first suction port 34 is disposed axially further away from the centroid of the sun rotor 26 than the second suction port 36. The asymmetry in geometry may also be generated by changing the shape of the portion of the first suction port 34 in communication with the first compression pair 44 relative to the shape of the portion of the second suction port 36 in communication with the second compression pair 44 while maintaining the overall size of the suction ports 36, 38.

The asymmetric geometry between the portions of the suction ports 34 and 36 in communication with the compression pairs 44 and 46 affects the time when each of the compression pockets 50, 52 (which angularly rotate with respect to the housing 12 as the rotors 26, 28, and 30 angularly rotate) rotates free of the axial (and/or radial) "obstruct" that is the housing 12 to come into communication with the shaded portions of the suction ports 34 and 36. In FIG. 2A, for example, each compression pocket 52 "closes" to the second suction port 36 by rotating angularly with respect to the housing 12 such that the compression pocket 52 passes behind the trailing edges 48 (as defined by the directions of rotation of the sun rotor 26 and the second planet rotor 30) and is "obstructed" by the housing 12 (and therefore, is not in direct communication with a portion of the suction port 36) before each compression pocket 50 passes behind the trailing edges 49 (as defined by the directions of rotation of the sun rotor 26 and the first planet rotor 28) and is "obstructed" by the housing 12 (and therefore, is not in direct communication with a portion of the suction port 34). Because both planet rotors 28 and 30 rotate at an equivalent angular velocity, the compression pockets 52 are "open" to the portion of the second suction port 36 (indicated by the shaded area 52) for a shorter period of time than compression pockets 50 are "open" to the portion of the first suction port 34 (indicated by the shaded area 50). The smaller size of the second suction port 36 in communication with the second compression pair 46 also results in the "closing" (as the sun rotor 26 rotates angularly with respect to the housing 12 such that it is obstructed by the trailing edge 48 of the housing 12 adjacent the sun rotor 26) of the first compression pocket 50 around the sun rotor 26 at a point in time prior to when the second compression pocket 52 (located generally diametrically across from the first compression pocket 50) "closes" (by rotating angularly with respect to the housing 12 such that it is obstructed by the trailing edge 49 of the housing 12 adjacent the sun rotor 26).

FIG. 2B shows another embodiment of the invention viewed from the same perspective as FIG. 2A. Similar to FIG. 2A, the portions of the suction ports 34 and 36 in communication with the compression pairs 44 and 46 have an asymmetric geometry with respect to each other. This asymmetric geometry is due to the different size and shape of the portion of the first suction port 34 in communication with the first compression pair 44 relative to the portion of the second suction port 36 in communication with the second compression pair 46. More specifically, the housing 12 is configured such that the portion of the second suction port 36 (indicated as shaded area 52 in FIGS. 2A and 2B) in communication with the axial end portion of the second compression pair 46 is larger than the portion of the first suction port 34 (indicated as shaded area 50 in FIGS. 2A and 2B) in communication with the axial end portion of the first compression pair 44.

Because the portion of the first suction port 34 in communication with the first compression pair 44 has a smaller size than the portion of the second suction port 36 in communication with the second compression pair 46, each compression pocket 50 "closes" to the first suction port 34 by rotating angularly with respect to the rotor housing 12 to pass behind the trailing edge 53 at a point in time before the corresponding compression pocket 52 "closes" to the second suction port 36 by rotating angularly with respect to the rotor housing 12 to pass behind the trailing edges 54.

The asymmetric geometry between the portions of the suction ports 34 and 36 in communication with the compression pairs 44 and 46 offsets the timing of the pressure pulsations associated with each suction port 34 and 36. Specifically, in FIGS. 2A and 2B, the different size and shape of the suction ports 34 and 36 allows each compression pocket 50 and 52 to "open" and/or "close" at a different period in time as the compression pairs 44 and 46 rotate. Offsetting the opening and/or closing of the compression pockets 50 and 52, results in reduced peak amplitude of pressure pulsations, and more uniform working fluid flow rates in the suction channel 32, which reduces compressor 10 sound and vibration.

Figure 3A:
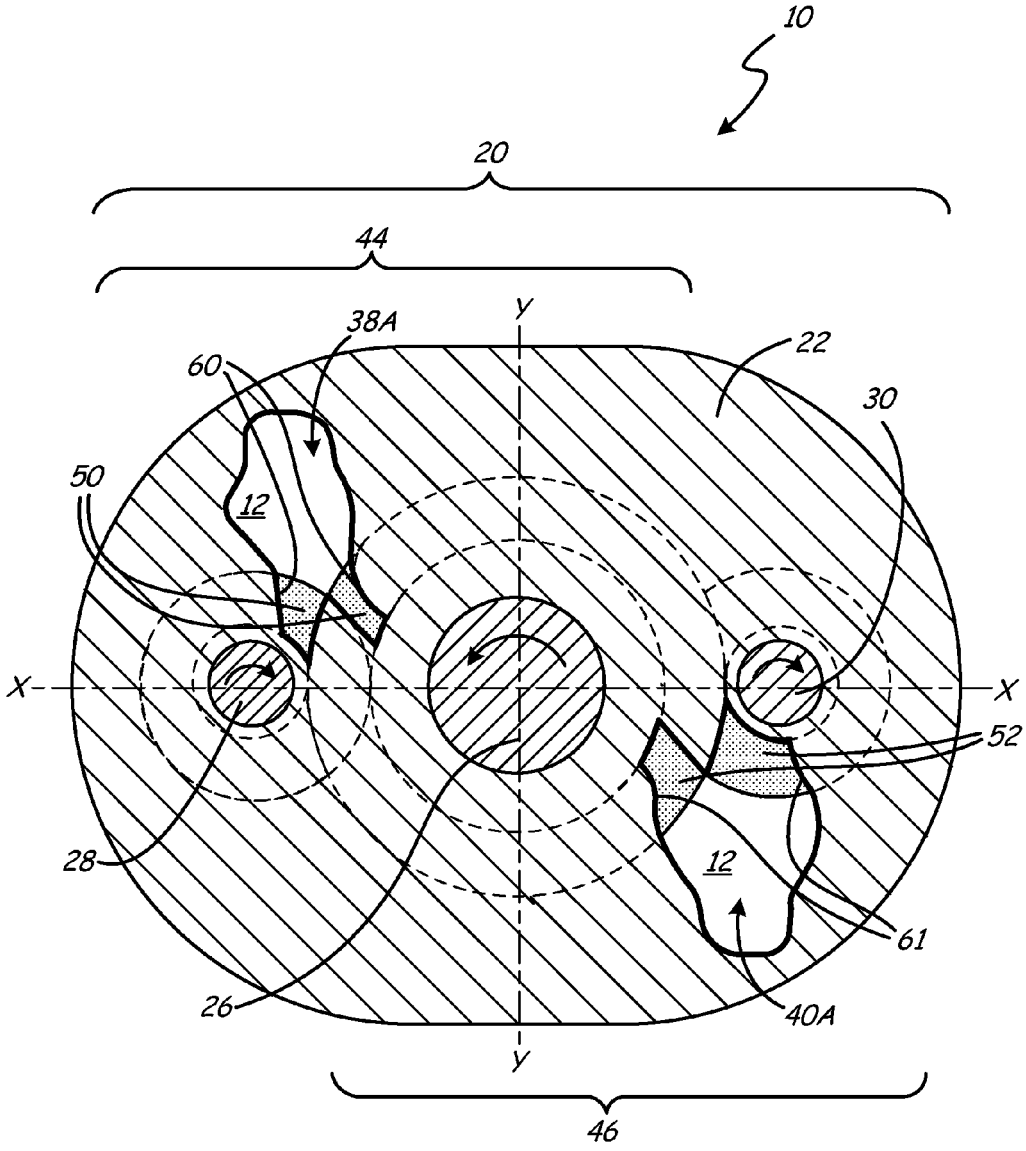
FIG. 3A is a view taken along line 3A-3A of FIG. 1 to show axial discharge ports in accordance with an embodiment of the present invention.
Figure 3B:
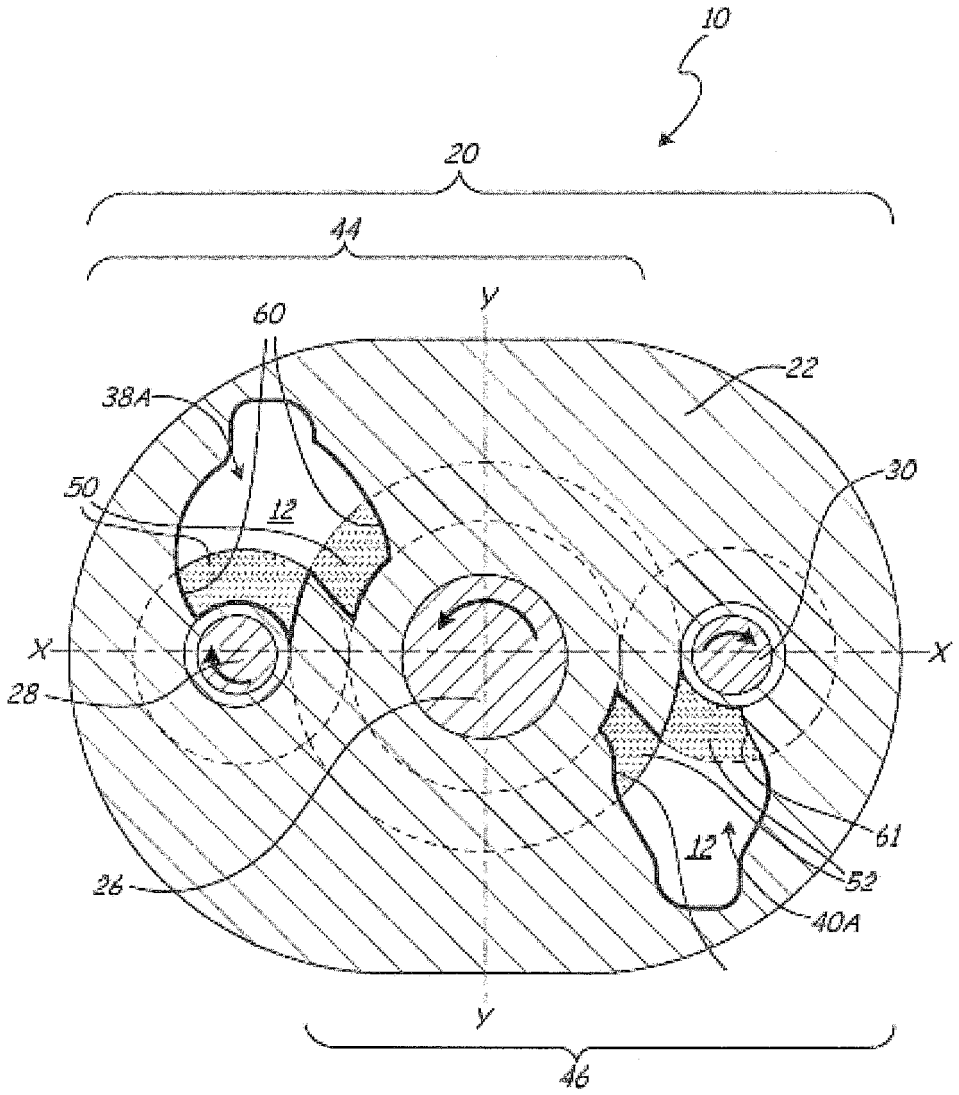
FIG. 3B is a view of the axial discharge ports taken from the same position as FIG. 3A showing another embodiment of the present invention.

FIGS. 3A and 3B are cross sectional views of the compressor 10 viewed from the same perspective illustrating different embodiments of the interior of the discharge housing section 22 downstream (as defined by the flow direction of the working fluid) of the rotors 26, 28, and 30, which are disposed in the rotor housing section 12. In FIGS. 3A and 3B, The discharge housing section 22 defines a first axial discharge port 38A section of the first discharge port 38 of FIG. 1, and the discharge housing section 22 defines a second axial discharge port 40A section of the second discharge port 40 of FIG. 1.

The axial discharge ports 38A and 40A are orifices in the housing 22 which allow for communication of the working fluid therethrough from the compression pairs 44 and 46 to the discharge channel 42 (FIG. 1). More specifically, the first axial discharge port 38A provides an outlet for high pressure working fluid exiting from the first compression pocket 50. The second axial discharge port 40A provides an outlet for high pressure working fluid exiting the second compression pocket 52. The discharge housing section 22 extends to immediately adjacent the axial ends of the rotors 26, 28, and 30 and abuts the rotor housing section 12. The cross sectional shape, size and disposition of the housing 22 with respect to the compression pairs 44 and 46 determines the geometry of the portions of the axial discharge ports 38A and 40A in communication with the compression pairs 44 and 46.

Because FIGS. 3A and 3B are end views of the rotors 26, 28, and 30, the first plurality of compression pockets 50 and second plurality of compression pockets 52 are shown as dashed bounded areas and as shaded areas around the rotors 26, 28, and 30. As previously discussed, the sun rotor 26 and first planet rotor 28 cooperate to define the first compression pair 44, with the first plurality of compression pockets 50 being defined between the flutes and lobes of a portion the sun rotor 26 and the inner wall of the housing 12, by any intermeshing space between the sun rotor 26 and the first planet rotor 28, and the flutes and lobes of the first planet rotor 28 and the inner wall of the housing 12. In FIGS. 3A and 3B, the portion of the first axial discharge port 38A which communicates with the first compression pair 44 corresponds to the shaded area also used to indicate the portion of the first compression pockets 50 in direct communication with the first axial discharge port 38A. In the shaded area, the first compression pockets 50 rotate angularly into alignment with the first axial discharge port 38A. The angular rotation of the first compression pockets 50 relative to the housing 12 allows the first compression pockets 50 to be exposed to and "open" to the first axial discharge port 38A for a limited time period.

Likewise, the sun rotor 26 and the second planet rotor 30 cooperate to define the second compression pair 46, with the second plurality of compression pockets 52 being defined between the flutes and lobes of the sun rotor 26 and the inner wall of the housing 12, by any intermeshing space between the sun rotor 26 and the second planet rotor 30, and the flutes and lobes of the second planet rotor and the inner wall of the housing 12. The portion of the second axial discharge port 40A which communicates with the second compression pair 46 corresponds to the shaded area used to indicate the portion of the second compression pockets 52 in direct communication with the second axial discharge port 40A. In the shaded area, the second plurality of compression pockets 52 rotate angularly into alignment with the second axial discharge port 40A. The angular rotation of the second compression pockets 52 relative to the housing 12 allows the second compression pockets 52 to be exposed to and "open" to the second axial discharge port 40A for a limited time period.

FIG. 3A shows a cross sectional view of the discharge housing section 22. In FIG. 3A, the portions of the axial discharge ports 38A and 40A in communication with the compression pairs 44 and 46 have an asymmetric geometry with respect to each other. This asymmetric geometry results from the different size and shape of the axial discharge ports 38A and 40A in communication with the compression pairs 44 and 46. In FIG. 3A, the portion of the first axial discharge port 38A in communication with the axial portion of the first compression pair 44 is smaller than the portion of the second axial discharge port 40A in communication with the axial portion of the second compression pair 46.

Similar to the suction ports 34 and 36, (FIGS. 2A and 2B) the asymmetry in geometry between the axial discharge ports 38A and 40A may be generated by shifting the disposition or alignment of the rotors 26, 28, and 30 with respect to the housing 22, while maintaining the same axial discharge port 38A and 40A size and shape. The shifting the disposition or alignment of the rotors 26, 28, and 30 with respect to the housing 22 generates an asymmetric geometry because the axial location where the axial discharge ports 38A and 40A would come into communication with the rotors 26, 28, and 30 would be different. The asymmetry in geometry may also be generated by changing the shape of the first axial discharge port 38A relative to the shape of the second axial discharge port 40A while maintaining the overall size of the axial discharge ports 38A and 40A in communication with the compression pairs 44 and 46.

The asymmetric geometry between the portions of the axial discharge ports 38A and 40A in communication with the compression pairs 44 and 46 affects the timing when each of the compression pockets 50 and 52 (which rotate angularly with respect to the rotor housing 12 and discharge housing 22 as the rotors 26, 28, and 30 rotate) rotates free of the axial "obstruct" that is the discharge housing 22 to come into communication with portions of the axial discharge ports 38A and 40A. For example, because the second axial discharge port 40A is larger in size than the first axial discharge port 38A in FIG. 3A, each compression pocket 52 "opens" to the second axial discharge port 40A (by angularly rotating past the leading edges 61 of the housing 22) at a point in time before the corresponding compression pocket 50 "opens" to the first axial discharge port 38A (by angularly rotating past the leading edges 60 of the housing 22). Thus, each compression pocket 52 begins to clear the leading edges 61 of the housing 22 and comes into direct communication with a portion of the second axial discharge port 40A before each corresponding compression pocket 50 begins to clear the leading edges 60 of the housing 22 and comes in direct communication with a portion of the first axial discharge port 38A. The compression pockets 52 remain "open" to the second axial discharge port 40A for a longer period of time than compression pockets 50 remain "open" to the first axial discharge port 38A.

FIG. 3B shows another embodiment of the invention viewed from the same perspective as FIG. 3A. Similar to FIG. 3A, the portions of the axial discharge ports 38A and 40A in communication with the compression pairs 44 and 46 have an asymmetric geometry with respect to each other. This asymmetric geometry is the result of the different size and shape of the axial discharge ports 38A and 40A in communication with the compression pairs 44 and 46. More specifically, the housing 22 is configured such that the portion of the first axial discharge port 38A in communication with the axial portion of the first compression pair 44 is larger than the portion of the second axial discharge port 40A in communication with the second compression pair 46. In FIG. 3B, asymmetry of the ports 38A and 40A allows each first compression pocket 50 to "open" to the portion of the first axial discharge port 38A at a point in time prior to when each corresponding second compression pocket 52 "opens" to the shaded portion of the second axial discharge port 40A.

The asymmetric geometry between the portions of the axial discharge ports 38A and 40A in communication with the compression pairs 44 and 46 offsets the timing of the pressure pulsations associated with each axial discharge port 38A and 40A. Specifically in FIGS. 3A and 3B, the different size and shape of the suction ports 34 and 36 allows each compression pocket 50 and 52 to "open" and/or "close" at a different period in time as the compression pairs 44 and 46 rotate. Offsetting the opening and/or closing of the compression pockets 50 and 52, results in reduced peak amplitude of pressure pulsations, and more uniform working fluid flow rates in the discharge channel 42, which reduces sound and vibration.

Figure 4A:
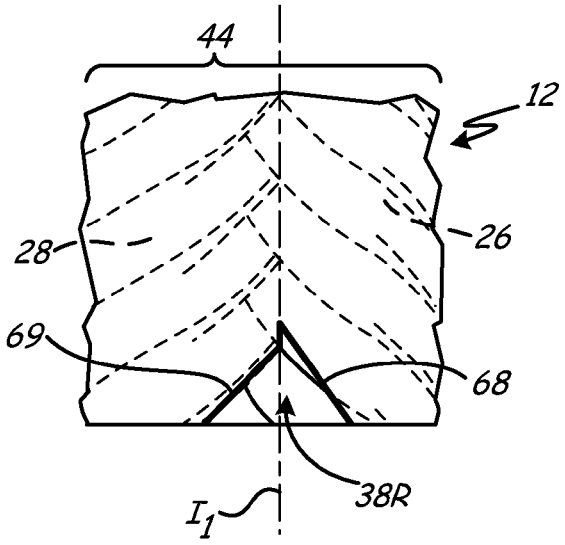
FIG. 4A is a partially schematic outline view of a first radial discharge port in accordance with one embodiment of the present invention with the rotors under the housing shown in phantom.

FIG. 4A is a top view of the first compression pair 44 with the rotor housing section 12 shown in phantom rather than cross hatched to better illustrate the intermeshing of the sun rotor 26 and first planet rotor 28. FIG. 4A shows the first radial discharge port 38R which extends generally axially along a downstream portion of the first compression pair 44. The first radial discharge port 38R also extends generally radially outward from the first compression pair 44 and would be visible from a top sectional view of the compressor 10.

Figure 4B:
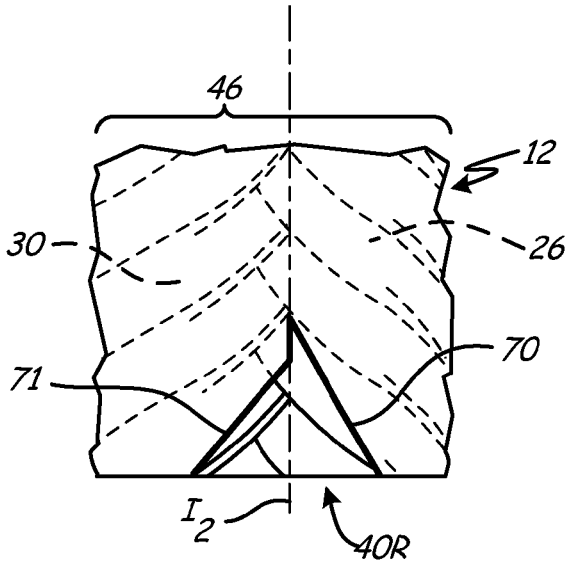
FIG. 4B is a partially schematic outline view of a second radial discharge port in accordance with the embodiment from FIG. 4A with the rotors under the housing shown in phantom.

FIG. 4B is a bottom view of the second compression pair 46 with the rotor housing section 12 shown in phantom rather than cross hatched to better illustrate the intermeshing of the sun rotor 26 and second planet rotor 30. FIG. 4B shows the second radial discharge port 40R which extends generally axially along a downstream portion of the second compression pair 46. The second radial discharge port 40R extends generally radially outward from the second compression pair 46.

The disposition of the radial discharge ports 38R and 40R with respect to the rotors 26, 28, and 30 may be varied to create an asymmetric housing 12 geometry, and therefore, the ports 38R and 40R need not necessarily be aligned between the compression pairs 44 and 46 along axes $I_1$ and $I_2$ as shown. In one embodiment, however, the first and second planet rotors 28 and 30 and the sun rotor 26 are aligned with respect to the housing 12 such that a leading or trailing edges 68 and 69 of the portion of the housing 12 which defines the first radial discharge port 38R is disposed radially further away from (and intersect further away from) the rotational axis of the sun rotor 26 than a leading or trailing edges 70 and 71 of the portion of the housing 12 which defines the second radial discharge port 40R. Similarly, the first and second planet rotors 28 and 30 and the sun rotor 26 may be aligned with respect to the housing 12 such that the leading or trailing edges 68 and 69 of the housing 12 which defines the first radial discharge port 40R is disposed axially further away from (and intersect further away from) the centroid of the sun rotor 26 than the leading or trailing edges 70 and 71 of the portion of the housing 12 which defines the second radial discharge port 40R.

In FIGS. 4A and 4B, the asymmetric geometry between the portions of the radial discharge ports 38R and 40R in communication with the radial portion of the compression pairs 44 and 46 is the result of the different size and shape of the radial discharge ports 38R and 40R. In FIG. 4A, the rotor housing 12 is configured such that the portion of the first radial discharge port 38R in communication with the first compression pair 44 is smaller than the portion of the second radial discharge port 40R in communication with the second compression pair 46. The difference in size and shape between the portions of the radial discharge ports 38R and 40R in communication with the compression pairs 44 and 46 allows the second compression pocket 52 (FIGS. 3A and 3B) to "open" to the second radial discharge port 40R prior to when the corresponding first compression pocket 50 (FIGS. 3A and 3B) "opens" to the first radial discharge port 38R.

Similar to the suction ports 34 and 36 (FIGS. 2A and 2B) and the axial discharge ports 38A and 40A (FIGS. 3A and 3B), the asymmetry in the geometry between the portions of the radial discharge ports 38R and 40R in communication with the compression pairs 44 and 46 may be generated by shifting the disposition or alignment of the rotors 26, 28, and 30 with respect to the housing 12, while maintaining the same radial discharge port 38R and 40R size and shape. Shifting the disposition or alignment of the rotors 26, 28, and 30 with respect to the housing 12 generates the asymmetric geometry because the axial and/or radial location along each compression pair 44 and 46 where the radial discharge ports 38R and 40R would come into communication with the rotors 26, 28, and 30 would be different. The asymmetry in geometry may also be generated by changing the shape of the first radial discharge port 38R relative to the shape of the second radial discharge port 40R while maintaining the overall size of the ports 38R and 40R in communication with the compression pairs 44 and 46.

By generating the asymmetric geometry between the portions of the radial discharge ports 38R and 40R in communication with the compression pairs 44 and 46, the amplitude of pressure pulsations associated with each port 38R and 40R may be offset from each other. The different size and shape of the radial discharge ports 38R and 40R allows each compression pocket 50 and 52 to open and/or close to the discharge ports 38R and 40R at a different period in time as the rotors 26, 28, and 30 rotate relative to the housing 12. By offsetting the opening and closing of the compression pockets 50 and 52, the peak amplitude of the pressure pulsations downstream of the rotors 26, 28, and 30 is reduced. A more uniform discharge flow rate in the discharge channel 42 (FIG. 1) and piping also results from the modifications to the discharge ports. The asymmetry of the radial discharge ports 38R and 40R reduces the noise and vibration levels in the attached piping and other system components.

The embodiments shown in FIGS. 2-4 are exemplary embodiments only. In other embodiments, different geometric housing configurations may result in different asymmetries between the portions of the ports in communication with the compression pairs 44 and 46. If more than three rotors are used in a compressor, the housing may be configured with more than two suction ports and more than two discharge ports. The housing may be configured to produce any number of asymmetries between the portions of the suction and/or discharge ports in communication with the rotors.

The housing may be simultaneously configured such that the suction ports and the discharge ports both have asymmetric geometries with respect to the compression pairs 44 and 46. This simultaneous asymmetric suction and discharge port arrangement may maintain the built-in volume ratio (Vi) on the both the planet rotors 28 and 30 without changing the helical shape, diameter, rotational velocity, or lobe/flute size of either planet rotor 28 and 30. As is known in the art, Vi is defined as a ratio of suction volume trapped in the compression pockets right after the compression pocket is closed off and discharge volume of the compression pocket just before the discharge port is open. A configuration that maintains Vi can be achieved, for example, by configuring the housing to create an asymmetric geometry between the portions of the first discharge port 38 and the second discharge port 40 (FIG. 1) in communication with a discharge portion of the compression pairs 44 and 46, while simultaneously configuring the housing to create an asymmetric geometry between the portions of the first suction port 34 and the second suction port 36 (FIG. 1) in communication with a suction portion of the compression pairs 44 and 46. Additional geometric arrangements of the housing which would result in an asymmetry between the axial and/or radial discharge ports and the axial and/or radial suction ports with respect to the compression pairs 44 and 46, while maintaining the Vi would be recognized by those skilled in the art.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A multi-rotor compressor comprising:

a sun rotor including a helical sun rotor flute;

a first planet rotor including a helical first planet rotor flute intermeshed with the sun rotor flute to define a first compression pair;

a second planet rotor including a helical second planet rotor flute intermeshed with the sun rotor to define a second compression pair; and a housing in which the first and second compression pairs are rotatably mounted, the housing including a first port solely defined by the housing in communication with the first compression pair, and a second port solely defined by the housing in communication with the second compression pair, wherein portions of the first and second ports which communicate with the first and second compression pairs have different geometry for offsetting pulsations in a working fluid flowing through the first and second ports respectively, the sun rotor, the first planet rotor and second planet rotor, having their centers of rotation arranged along a common straight line axis;

wherein the first port and second port comprise suction ports and the portions of the first and second suction ports which communicate with the first and second compression pairs have different geometry such that there is an offset in the onset and/or termination of a suction flow of a working fluid through the first suction port with respect to the second suction port;

wherein the housing is configured such that the size of the portion of the first suction port in communication with the first compression pair is larger than the size of the portion of the second suction port in communication with the second compression pair.

2. The compressor of claim 1, wherein the portions of the first and second ports which communicate with the first and second compression pairs have different geometry such that there is an offset in the onset and/or termination of a discharge flow of a working fluid through a first discharge port with respect to a second discharge port.

3. The compressor of claim 1, wherein a third port and a fourth port comprise discharge ports and a size and/or shape of the portion of the third port in communication with an axial end portion of the first compression pair is different than the size and/or shape of the portion of the fourth port in communication with an axial end portion of the second compression pair.

4. The compressor of claim 3, wherein the size and/or shape of the portion of the third port in communication with a radial portion of the first compression pair is different than the size and/or shape of the portion of the fourth port in communication with a radial portion of the second compression pair.

5. The compressor of claim 3, wherein the disposition of the portion of the third port in communication with the first compression pair differs from the disposition of the portion of the fourth port in communication with the second compression pair with respect to the rotational axis and/or centroid of the sun rotor.

6. The compressor of claim 3, further comprising a first plurality of compression pockets which extend helically along a portion of the sun rotor and the first planet rotor in the space between flutes and lobes of the first compression pair and the housing, and a second plurality of compression pockets which extend helically along a portion of the sun rotor and the second planet rotor in the space between flutes and lobes of the second compression pair and the housing, each pocket from the first plurality of compression pockets rotates angularly into and/or out of communication with the portion of the third port in communication with the first compression pair at a different period in time than each pocket from the second plurality of compression pockets rotates angularly into and/or out of communication with the portion of the fourth port in communication with the second compression pair.

7. The compressor of claim 6, wherein the working fluid is driven helically along the first and second plurality of pockets and is discharged through the third and fourth ports, whereby there is an offset in pressure pulsations associated with the flow of the working fluid through the third port with respect to the fourth port due to the different geometry of the portion of the third port in communication with the first compression pair with respect to the portion of the fourth port in communication with the second compression pair.

8. The compressor of claim 3, further comprising a first suction port and a second suction port in the housing, a portion of the first suction port communicates with a suction portion of the first compression pair and a portion of the second suction port communicates with a suction portion of the second compression pair, wherein the geometry of the portion of the first suction port in communication with the first compression pair differs from the geometry of the portion of the second suction port in communication with the second compression pair, whereby the planet rotors are provided with equal built-in volume ratios (Vi).

9. The compressor of claim 1, wherein the disposition of the portion of the first suction port in communication with the first compression pair differs from the disposition of the portion of the second suction port in communication with the second compression pair with respect to the rotational axis and/or centroid of the sun rotor.

10. The compressor of claim 1, wherein the size and/or shape of the portion of the first suction port in communication with an axial end portion of the first compression pair is different than the size and/or shape of the portion of the second suction port in communication with an axial end portion of the second compression pair.

11. The compressor of claim 1, wherein the size and/or shape of the portion of the first suction port in communication with a radial portion of the first compression pair is different than the size and/or shape of the portion of the second suction port in communication with a radial portion of the second compression pair.

12. The compressor of claim 1, further comprising a first plurality of compression pockets which extend helically along a portion of the sun rotor and the first planet rotor in the space between flutes and lobes of the first compression pair and the housing, and a second plurality of compression pockets which extend helically along a portion of the sun rotor and the second planet rotor in the space between flutes and lobes of the second compression pair and the housing, each pocket from the first plurality of compression pockets rotates angularly into and/or out of communication with the portion of the first suction port in communication with the first compression pair at a different period in time than each pocket from the second plurality of compression pockets rotates angularly into and/or out of communication with the portion of the second suction port in communication with the second compression pair.

13. The compressor of claim 12, wherein the working fluid is drawn through the first and second suction ports and is received in the first and second plurality of pockets, whereby there is an offset in pressure pulsations associated with the flow of the working fluid through the first suction port with respect to the second suction port due to the different geometry of the portion of the first suction port in communication with the first compression pair with respect to the portion of the second suction port in communication with the second compression pair.

14. The compressor of claim 1, further comprising a first discharge port and a second discharge port in the housing, a portion of the first discharge port communicates with a discharge portion of the first compression pair and a portion of the second discharge port communicates with a discharge portion of the second compression pair, wherein the geometry of the portion of the first discharge port in communication with the first compression pair differs from the geometry of the second discharge port in communication with the second compression pair, whereby the planet rotors are provided with equal built-in volume ratios (Vi).

* * * * *